US005263785A

United States Patent [19]

Negoro et al.

[11] Patent Number: 5,263,785

[45] Date of Patent: * Nov. 23, 1993

[54] SHEET GUIDE MECHANISM FOR USE IN AN IMAGING DEVICE

[75] Inventors: Ikuo Negoro, Sakado; Kiyoshi Negishi, Tsurugashima; Masahiro Kita, Tokyo, all of Japan

[73] Assignee: Asahi Kogaku Kogyo Kabushiki Kaisha, Tokyo, Japan

[ * ] Notice: The portion of the term of this patent subsequent to Jan. 21, 2009 has been disclaimed.

[21] Appl. No.: 864,198

[22] Filed: Apr. 3, 1992

Related U.S. Application Data

[63] Continuation of Ser. No. 730,093, Jul. 15, 1991, abandoned, which is a continuation of Ser. No. 649,295, Jan. 30, 1991, Pat. No. 5,082,382, which is a continuation of Ser. No. 385,367, Jul. 27, 1989, abandoned.

[30] Foreign Application Priority Data

Jun. 16, 1989 [JP] Japan ..... 1-153747
Jul. 29, 1989 [JP] Japan ..... 63-189866

[51] Int. Cl.[5] ..... B41J 15/00
[52] U.S. Cl. ..... 400/613.2; 400/619
[58] Field of Search ..... 400/613.2, 613.3, 613.4, 400/679, 680, 578, 619, 642, 646, 647, 647.1; 248/918

[56] References Cited

U.S. PATENT DOCUMENTS

| | | | |
|---|---|---|---|
| 2,534,391 | 12/1950 | Duyke | 197/133 |
| 4,696,591 | 9/1987 | Boyden | 400/613.2 |
| 4,749,295 | 6/1988 | Bankur et al. | 400/613.2 |
| 4,878,428 | 11/1989 | Watarai | 400/119 |
| 5,082,382 | 1/1992 | Negoro et al. | 400/613.2 |

FOREIGN PATENT DOCUMENTS

| | | |
|---|---|---|
| 2912883 | 10/1980 | Fed. Rep. of Germany . |
| 3531420 | 3/1987 | Fed. Rep. of Germany . |
| 59-120480 | 7/1984 | Japan . |
| 1147773 | 4/1966 | United Kingdom . |

*Primary Examiner*—Edgar S. Burr
*Assistant Examiner*—Ren Yan
*Attorney, Agent, or Firm*—Sandler, Greenblum & Bernstein

[57] ABSTRACT

An apparatus utilizing a continuous-form sheet having a plurality of perforations at predetermined intervals of length is provided with a plate member for upwardly guiding the sheet discharged from the apparatus. A connect member provided on the plate member, as well as the apparatus, are arranged to be brought into and out of engagement with each other. The continuous-form sheet discharged from the apparatus is bent at the perforations and falls beyond the plate to be neatly folded.

32 Claims, 4 Drawing Sheets

SHEET GUIDE MECHANISM FOR USE IN AN IMAGING DEVICE

This application is a continuation of application Ser. No. 07/730,093, filed Jul. 15, 1991, now abandoned; which is a continuation of application Ser. No. 07/649,295, filed Jan. 30, 1991, which issued as U.S. Pat. No. 5,082,382 on Jan. 21, 1992, which is a continuation of application Ser. No. 07/385,367, filed Jul. 27, 1989, which is now abandoned.

BACKGROUND OF THE INVENTION

The present invention relates to a continuous-form sheet guide mechanism for a printer in which an image is formed on the continuous-form sheet, by the so-called electrophotographic processes and which is capable of being folded at a certain interval of length, and more particularly to a guide mechanism for controlling a direction along which the continuous-form sheet is discharged from the printer.

Imaging devices, such as laser printers have recently been widely used, in which a laser beam is modulated in accordance with graphics, characters and other image information is scanned on a surface of an electrically charged sensitized body (for example, photoconductive drum) for exposure to form a electrostatic latent images, and which is then developed to a visible image and transferred and fixed by a duplication processes (so-called electrophotographic processes), to thereby obtain a hard copy carrying image information on the continuous-form sheet. Small and in expensive apparatuses using semiconductor lasers have been vigorously commercialized.

While such laser printers or the like image formation apparatuses sometimes use cut-sheet type recording sheets having a certain size, continuous-form sheet capable of being folded at a predetermined interval of length, (so-called fan-folded sheet), is more often used to allow them to deliver hard copies with image information consecutively at a high speed. The fan-folded sheet is used as such a continuous-form sheet. The fan-folded sheet has sprocket holes provided along a longitudinal direction at a certain interval of pitch on both sides of the sheet width, with a widthwise extending perforation at each folding line spaced by a certain interval of length with each other.

When using the continuous-form sheet, such as the folded sheet, the continuous-form sheet is heated and pressed, i.e., thermally pressed by heat rollers as part of a fixing unit of the imaging devices. This causes folding lines at the perforations to tend to disappear, making folding operations difficult.

Since the folding lines of the continuous-form sheet are eliminated by the thermal press in the fixing process, causing trouble in the folding operations, the continuous-form sheet, that should have been stacked in a neatly folded state after being discharged from the imaging device, is likely to be placed in a sort of mess around a discharge outlet of the continuous-form sheet.

SUMMARY OF THE INVENTION

It is therefore an object of the present invention to provide an improved sheet guide mechanism having a function capable of easily and reliably folding a continuous-form sheet after being outputted from the thermal pressure process of an imaging device.

For this purpose, according to the invention, there is provided a sheet guide mechanism for an imaging device which employs a continuous form having a plurality of perforations at predetermined intervals of length along the longitudinal direction of said continuous form. The guide mechanism comprises a plate member that is vertically arranged at the outlet side of the imaging device to upwardly guide the continuous form discharged from the device.

With the arrangement as above, the continuous-form sheet discharged from the apparatus is guided toward a distant above point because the tray obliquely rises from the under part of the discharge outlet of the apparatus toward a distant point above. The paper is bent at the folding lines spaced at a certain interval of length by its own weight, falling upon a place beyond the tray to be folded there.

DESCRIPTION OF THE ACCOMPANYING DRAWINGS

DESCRIPTION OF THE EMBODIMENTS

The present invention will now be described with reference to the accompanying drawings.

Figure 1:
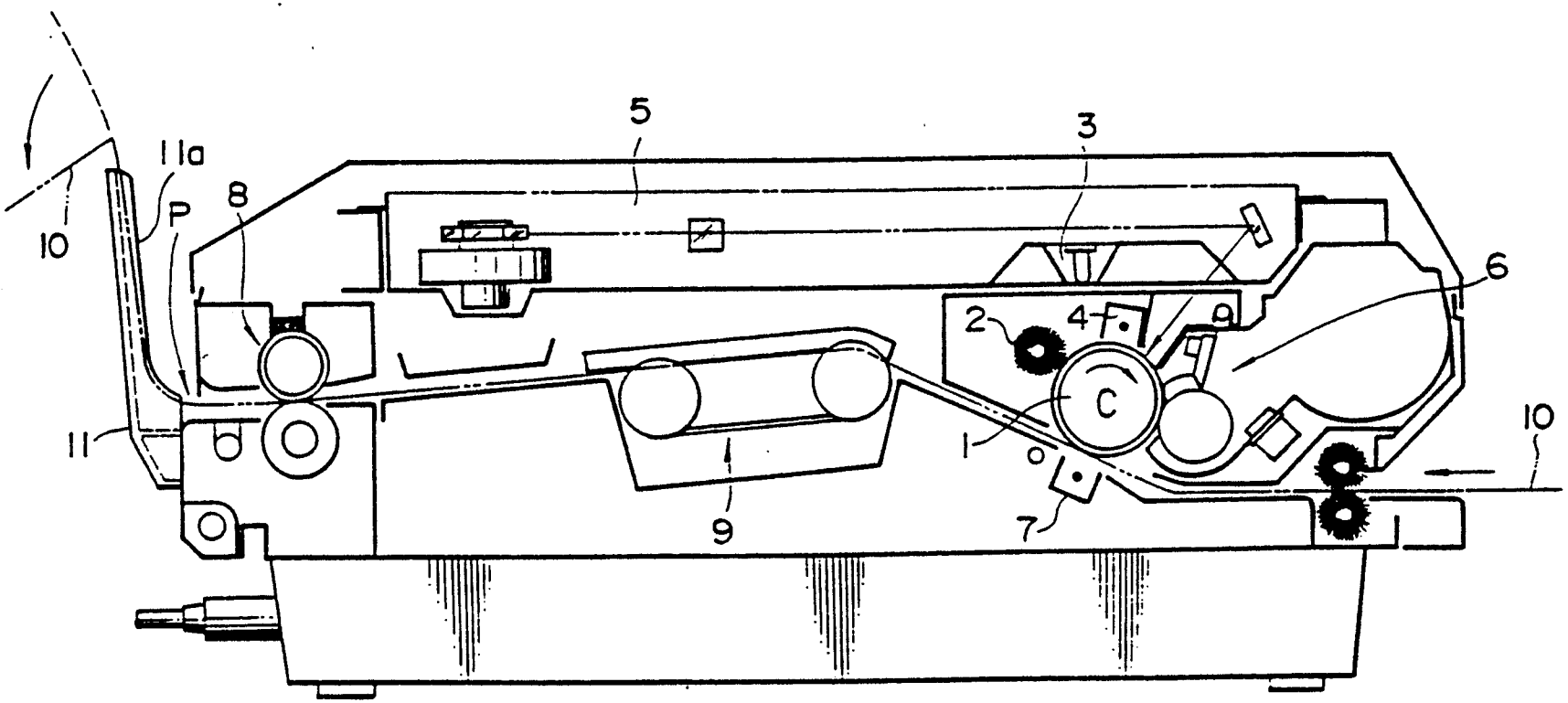
FIG. 1 is a side elevational view showing a general configuration of a laser printer incorporating a preferred embodiment of a sheet guide mechanism according to the present invention.
Figure 2:
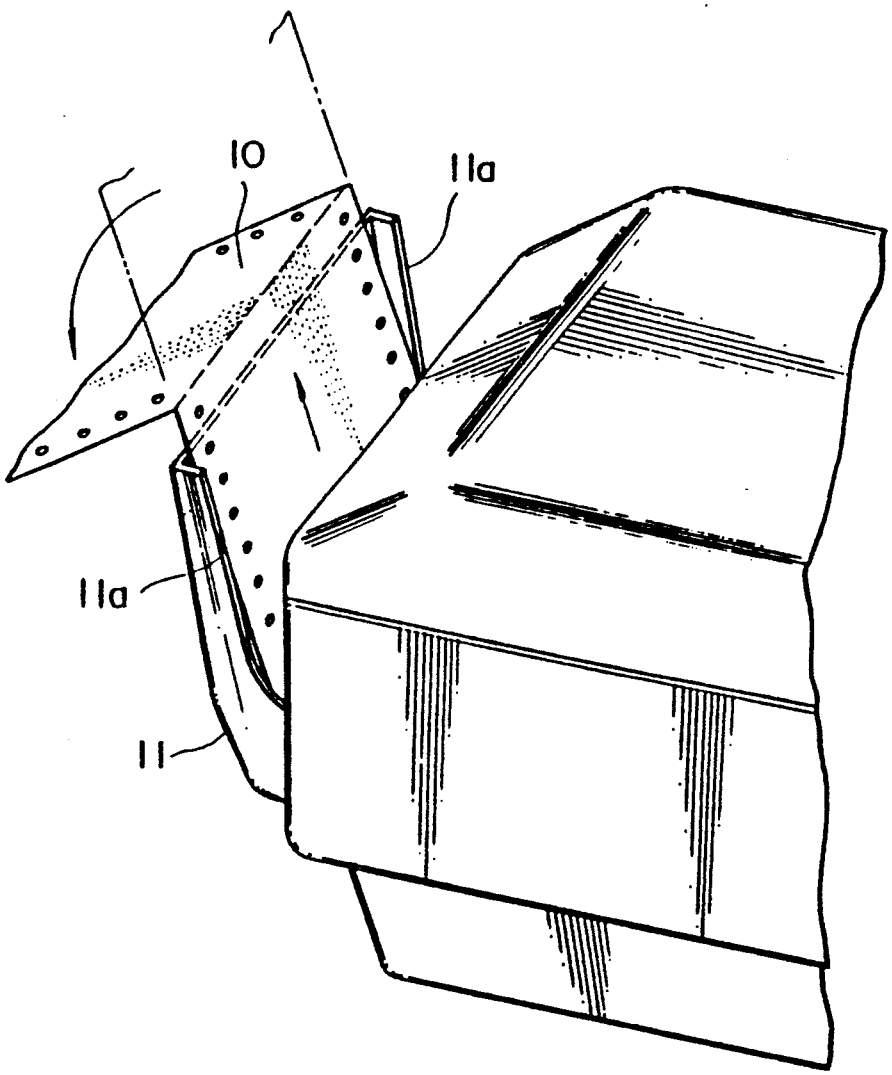
FIG. 2 is a partial perspective view showing a discharging operation of a continuous-form sheet in the laser printer shown in FIG. 1.

FIG. 1 is a side elevational view showing a general configuration of a laser printer incorporating a preferred embodiment of a sheet guide mechanism according to the present invention; and FIG. 2 is a partial perspective view showing a discharging operation of a continuous-form sheet in the laser printer shown in FIG. 1.

The laser printer prints out information, characters, numerals and the like corresponding to the codes stored in a host computer, or the like, on a continuous-form sheet 10 by means of the so-called electrophotographic processes.

Around a photoconductive drum 1 are a toner-cleaning station 2, a de-charging station 3, a charging station 4, an optical scanning system 5 for leading a laser beam modulated according to the input information onto a circumferential surface of the photoconductive drum 1, a developing station 6 and a transferring station 7 arranged in the aforementioned order in the rotational direction of the photoconductive drum 1 (as indicated by arrow "C"). A fixing station 8 is located in a predetermined position forward of a feeding direction of the continuous-form sheet 10. In the feed path for the continuous-form sheet 10 from the photoconductive drum 1 to the fixing station 8 is an inner guide mechanism 9 for guiding the continuous-form sheet 10 in a predetermined direction with resisting force applied to both ends of the continuous-form sheet 10 to appropriately control its transporting operation.

The surface of the photoconductive drum 1 is scanned by the laser beam emitted from the optical scanning system 5 in its longitudinal direction thereof (main scanning). While this main scanning is repeated, the photoconductive drum 1 is rotated in the direction indicated by the arrow "C" so that the surface thereof is scanned in the direction opposite to the rotation of the photoconductive drum 1 (auxiliary scanning). With this arrangement, the photoconductive drum 1 has a latent image formed on its surface which is then developed to a visible image, (or toner image) by means of the developing station 6. Formation of a latent image and development thereof is thus accomplished by the so-called electrophotographic processes. The aforementioned toner image is then transferred from the photoconductive drum 1 to the surface of the continuous-form sheet 10. After fixing the transferred toner image by means of the fixing station 8, the continuous-form sheet 10 is discharged through sheet outlet "P".

The surface of the photoconductive drum 1 is cleaned by the toner-cleaning station 2 before each scanning (latent image formation) to remove the residual toner of the previous process, and is electrically charged by the charge station 4 across the whole area thereof.

The continuous-form sheet 10 comprises a continuous form which is to be folded at a predetermined interval of length. Consecutive sprocket holes formed on both edges of the sheet at a certain pitch. The folding line at which the sheet is folded at a predetermined interval has perforations to facilitate separating one section of the sheet from another. The paper sections are thus torn apart after the continuous printing to be put into a record file.

Figure 3A:
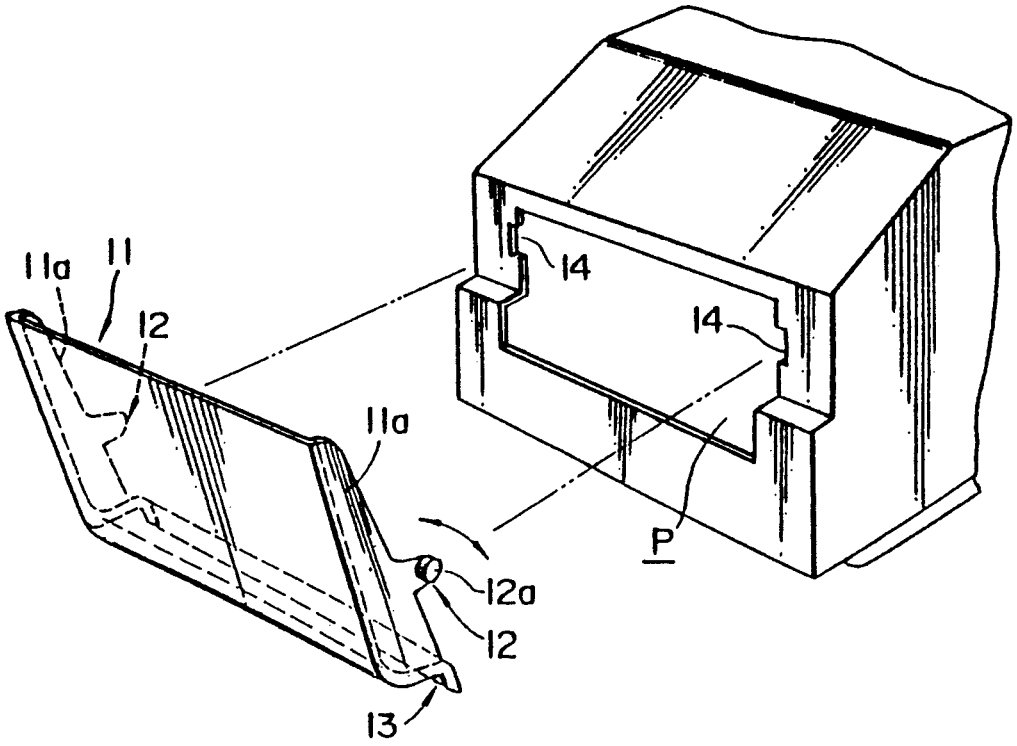
FIG. 3(A) is a disassembled perspective view of a second embodiment of the present invention.
Figure 3B:
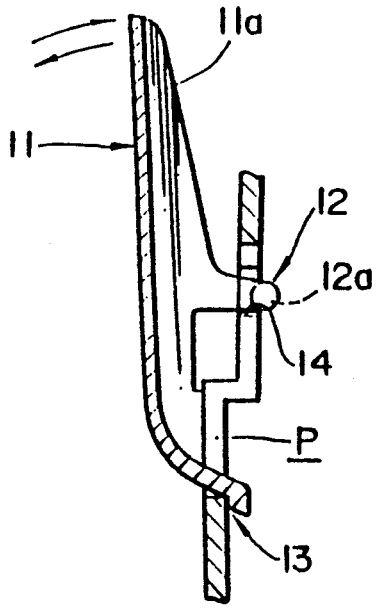
FIG. 3(B) is a vertical sectional view when the guide mechanism is mounted.
Figure 4A:
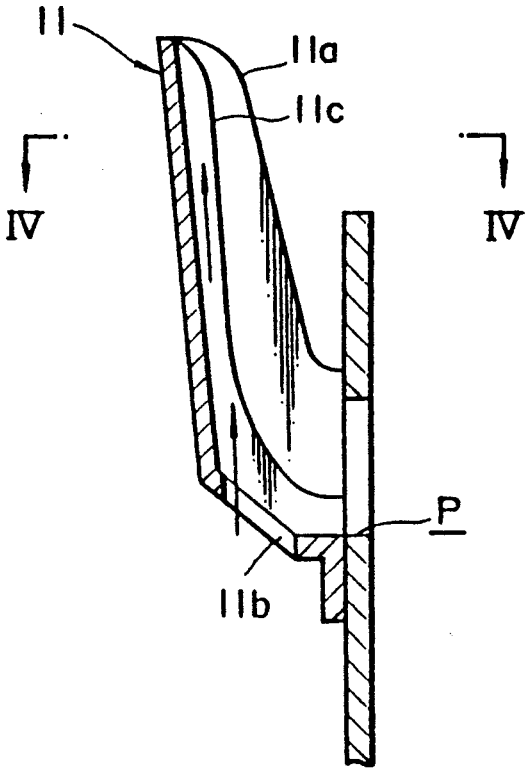
FIG. 4(A) is a illustrative view of a third embodiment of the present invention.

Proximate the sheet outlet "P" for the continuous-form sheet 10 is a guide tray 11 for controlling the direction in which the continuous-form sheet 10 is discharged. The guide tray 11 has a width that is a little greater than the width of the continuous-form sheet 10. Sides 11*a* and 11*b* of the guide tray 11 are bent in the same direction so as to be perpendicular to a base portion 11*s*. The bent portions of the sides 11*a* and 11*b* are arranged in opposition to the sheet outlet "P". One end of the tray is fixedly engaged with the underside of the outlet "P" so that the tray rises from the sheet outlet "P" obliquely toward some distant remote point. The other (i.e., upper) end of the tray terminates at an abrupt edge, as illustrated in FIGS. 3(A), 3(B) and 4(A).

With this arrangement, since the guide tray 11 rises from the underside of the sheet outlet "P" toward some remote point above, the continuous-form sheet 10 discharged from the sheet outlet "P" is guided toward the remote point above and at a point where it leaves a top edge of the guide tray 11, and is downward bent by its weight at the perforation with a folding line to be folded at a certain interval. Thus, the sheet falls upon a place beyond the tray 11 in a neatly folded state. Since the continuous-form sheet 10 is weakened at its perforations than at other parts of sheet, the sheet guided by the upwardly projecting tray yields to its own weight so as to be always bent at the perforations. Even when the folding line at the perforation is eliminated by the heat press in the fixing process with fixing station 8, making folding at the perforated line difficult, the lower rigidity at the perforation than in other parts is maintained, so that the sheet is always bent at the perforations. This allows the sheet to fall on a place beyond the guide tray 11 in a neatly folded condition.

The continuous-form sheet 10 is vibrated when it falls, as described above, beyond the guide tray 11. This vibration propagates to the sheet section of the continuous-form sheet 10 that has already fallen beyond the guide tray 11. Such vibration of the continuous-form sheet 10 that has fallen beyond the guide tray 11 promotes its folding operation to further help it be neatly folded.

The continuous-form sheet 10 is thus always bent at the perforation and is neatly folded by means of a simple structure comprising a guide tray 11 provided at the paper outlet "P".

Another embodiment of the guide tray 11 will be described below with reference to FIG. 3 and FIG. 4.

The guide tray 11 is, as shown in FIG. 3(A), provided at each side portion 11*a* or 11*b* with which it is mounted on the laser beam printer with a mounting projection 12 having a predetermined width, which has integrally formed therewith an engagement projection 12*a* at an outer leading end thereof. The bottom edge of the guide tray 11 extends downward to provided an engagement hook 13.

The opening portion for installation, i.e., the sheet outlet "P", through which the guide tray 11 is mounted on the laser beam printer has at each of its lateral edges an engagement section 14 that is formed to enable engagement with the engagement projection 12*a* by a resilient deformation of the mounting projection 12.

The hook 13 of the guide tray 11 is inserted into the opening portion (sheet outlet "P") and is hooked on its bottom edge, with the engagement projection 12 pushed into the opening portion through the engagement section 14. The mounting projection 12 then yields to be deformed, allowing the engagement projection 12*a* to be fully placed in the printer body. After this, the mounting projection 12 is restored from its deformation, whereby the guide tray 11 is engaged and installed in position as shown in FIG. 3(B).

According to this arrangement, when an excessive force is inadvertently applied to the upwardly projecting guide tray 11 in an arrow-indicated shown in FIG. 3B, the guide tray 11 slips out of the engagement 14, with no damage to the guide tray 11.

Figure 4B:
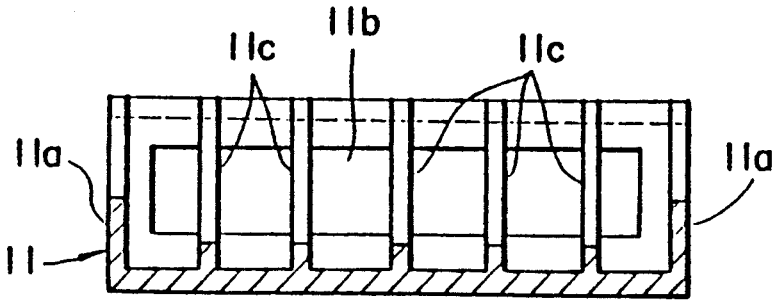
FIG. 4(B) is a sectional view taken along line IV—IV of FIG. 4(A).

Illustrated in FIGS. 4A and 4B are opening portions 11*d* formed at the bottom of the guide tray 11 and a plurality of rib portions 11*e* formed on the inside surface of the guide tray 11 (the surface, along which the continuous-form sheet 10 is discharged from the printer body is guided in contact therewith). The continuous-form sheet 10 is thus guided along the top edges of the ribs 11*e*.

With this arrangement, the continuous-form sheet 10 is heated to a high temperature for thermal fixing in the fixing station 8 and is rapidly cooled by the air flowing in FIG. 4A direction indicated by an arrow in the to thereby quickly finish the fixing process (i.e., cooling the continuous-form sheet 10 and solidifying a toner to be fixed on the surface of the continuous-form sheet 10) while also preventing curling of the continuous-form sheet 10.

What is claimed is:

1. A sheet guide mechanism for an imaging device having a fixing device which comprises means for heat pressing a continuous form, said continuous form having a plurality of transverse perforations at predetermined intervals of length along a longitudinal direction of said continuous form so as to divide said continuous form into a plurality of sheets, said sheet guide mechanism comprising:

an inclined plate member having a top edge and being arranged at an outlet side of said imaging device to upwardly guide said continuous form that is discharged from said device, said inclined plate member comprising means for causing each of said transverse perforations of said continuous form to pass over said top edge of said plate member and to be guided in an upward direction beyond said top edge, the weight of said continuous form causing said continuous form to be bent downward and away from said outlet side of said imaging device so that said continuous form is folded into a predetermined arrangement defined by the placement of said transverse preparations after passing over said top edge of said plate member; and an installation member that selectively engages said plate member to said imaging device.

2. The sheet guide mechanism according to claim 1, further comprising a plurality of opening portions provided on said plate member.

3. The sheet guide mechanism according to claim 2, wherein said opening portions are provided at a predetermined area of a bottom side edge of said plate member.

4. The sheet guide mechanism according to claim 1 wherein said plate member includes a plurality of rib portions formed on a surface on which said continuous form travels.

5. The sheet guide mechanism according to claim 4 wherein said rib portions are arranged parallel to a direction along which said continuous form travels.

6. The sheet guide mechanism according to claim 1, wherein said top edge comprises an abrupt edge of said plate member.

7. The imaging device according to claim 1, wherein said plate member comprises a guiding surface which extends in a generally vertical direction.

8. The imaging device according to claim 1, wherein said plate member comprises means defining a support path upon which said continuous form is supported, said support path comprising a substantially planar support structure which extends from said edge downward for a substantial distance along said support path.

9. A sheet guide mechanism for an imaging device which employs a continuous form having a plurality of transverse perforations at predetermined intervals of length along a longitudinal direction of said continuous form, comprising:

a plate member arranged at an outlet side of said imaging device such that said plate member extends upwardly, a top edge of said plate member being spaced from said bottom edge by a predetermined distance, said plate member operating to upwardly guide said continuous form that is discharged from said imaging device over said top edge of said plate member and away from said outlet side of said imaging device, so that said continuous form is folded into said predetermined intervals of length; and means for selectively engaging said plate member to said outlet side of said imaging device in said upwardly extended arrangement, wherein said engaging means comprises an install member having a first connect member that is provided on said plate member, and a second connect member that is provided on said sheet guide mechanism, said first and second connect members being adapted to be brought into and out of engagement with each other.

10. The sheet guide mechanism of claim 9, further comprising a plurality of opening portions provided on said plate member.

11. The sheet guide mechanism of claim 10, wherein said opening portions are provided at a predetermined area of a bottom side edge of said plate member.

12. The sheet guide mechanism of claim 9, wherein said plate member includes a plurality of rib portions that are formed on a surface that contacts said continuous form.

13. The sheet guide mechanism of claim 12, wherein said rib portions are arranged parallel to a direction of travel of said continuous form.

14. A sheet guide mechanism for an imaging device which employs a continuous form having a plurality of transverse perforations at predetermined intervals of length along a longitudinal direction of said continuous form, comprising:

a plate member having a bottom edge and a top edge, said bottom edge being attached to an outlet side of said imaging device such that said plate member is positioned to extend upwardly, said top edge being spaced apart from said bottom edge by a predetermined distance, said plate member operating to guide said continuous form discharged from said imaging device over said top edge of said plate member away from said outlet side of said imaging device, said continuous form being bent down over said top edge of said plate member due to the weight of said continuous form, folding said continuous form into said predetermined intervals of length;

a first connect member that is provided on said plate member; and a second connect member that is provided on said device which is adapted to be brought into and out of engagement with said first connect member.

15. The sheet guide mechanism of claim 14, further comprising a plurality of opening portions provided on said plate member.

16. The sheet guide mechanism of claim 15, wherein said opening portions are provided at a predetermined area of a bottom side edge of said plate member.

17. A method for stacking a continuous form that is ejected from an imaging device, in which the continuous form has a plurality of transverse perforations at predetermined intervals of length along a longitudinal direction of the continuous form so as to divide the continuous form into a plurality of sheets, comprising the steps of:

guiding the ejected continuous form towards a point located above an outlet side of the imaging device with a plate member that is substantially vertically arranged proximate the outlet side of the imaging device, the plate member having a first connect member that selectively engages a second connect member that is provided on the imaging device, the ejected continuous form being upwardly guided towards a top edge of the plate member;

providing a first connect member on the plate member and a second connect member on the imaging device to be selectively engageable with the first connect member;

passing the ejected continuous form over the top edge of the plate member so that the weight of the ejected continuous paper causes the ejected continuous form to be bent downward towards a point that is located beyond the plate member that is arranged proximate the outlet side of the imaging device; and folding the ejected continuous form into a predetermined arrangement defined by the placement of the transverse perforations.

18. The method of claim 17, wherein the step of folding the ejected continuous form includes dispensing the ejected continuous paper onto a location that is beyond the plate member.

19. A sheet guide mechanism for an imaging device having a fixing device which comprises means for heat pressing a continuous form, said continuous form having a plurality of transverse perforations at predetermined intervals of length along a longitudinal axis of said continuous form so as to divide said continuous form into a plurality of sheets, said sheet guide mechanism comprising:

an inclined plate member having a top edge and being arranged at an outlet side of said imaging device to upwardly guide said continuous form that is discharged from said device, said inclined plate member comprising means for causing each of said transverse perforations of said continuous form to pass over said top edge of said plate member and to be guided in an upward direction beyond said top edge, the weight of said continuous paper causing said continuous form to be bent downward and away from said outlet side of said imaging device so that said continuous form is folded into a predetermined arrangement after passing over said top edge of said plate member; and a connection member provided on said plate member that is adapted to brought into and out of engagement with said imaging device.

20. The sheet guide mechanism according to claim 19, wherein said top edge comprises an abrupt edge of said plate member.

21. The imaging device according to claim 19, wherein said plate member comprises a guiding surface which extends in a generally vertical direction.

22. The imaging device according to claim 19, wherein said plate member comprises means defining a support path upon which said continuous form is supported, said support path comprising a substantially planar support structure which extends from said edge downward for a substantial distance along said support path.

23. An imaging device comprising:

means for forming an image on a continuous form having a plurality of transverse perforations at predetermined intervals of length along a longitudinal direction of said continuous form so as to divide said continuous form into a plurality of sheets;

a fixing device which comprises means for heat pressing said continuous form, and thereby fixing the image onto said continuous form;

a sheet guide mechanism comprising an inclined plate member having a top edge and being arranged at an outlet side of said imaging device to upwardly guide said continuous form that is discharged from said device, said inclined plate member comprising means for causing each of said transverse perforations of said continuous form to pass over said top edge of said plate member and to be guided in an upward direction beyond said top edge, the weight of said continuous form causing said continuous form to bent downwardly and away from said outlet side of said imaging device so that said continuous form is folded into a predetermined arrangement defined by the placement of said transverse perforations after passing over said top edge of said plate member; and an installation member that selectively engages said plate member to said imaging device.

24. The sheet guide mechanism according to claim 23, wherein said top edge comprises an abrupt edge of said plate member.

25. The imaging device according to claim 23, said plate member further comprising a plurality of opening portions provided on said plate member.

26. The imaging device according to claim 25, wherein said opening portions are provided within a predetermined area of a bottom side edge of said plate member.

27. The imaging device according to claim 23, wherein said plate member includes a plurality of rib portions formed on a surface of said plate member on which said continuous form travels.

28. The imaging device according to claim 27, wherein said rib portions are arranged in parallel to a direction along which said continuous form travels.

29. The imaging device according to claim 23, wherein said plate member comprises a guiding surface which extends in a generally vertical direction.

30. The imaging device according to claim 23, wherein said plate member comprises means defining a support path upon which said continuous form is supported, said support path comprising a substantially planar support structure which extends from said edge downward for a substantial distance along said support path.

31. A sheet guide mechanism for an imaging device having a fixing device which comprises means for heat pressing a continuous form, said continuous form having a plurality of transverse perforations at predetermined intervals of length along a longitudinal direction of said continuous form so as to divide said continuous form into a plurality of sheets, said sheet guide mechanism comprising:

an inclined plate member having a top edge and being arranged at an outlet side of said imaging device to upwardly guide said continuous form that is discharged from said device, said inclined plate member comprising means for causing each of said transverse perforations of said continuous form to pass over said top edge of said plate member and to be guided in an upward direction beyond said top edge, the weight of said continuous form causing said continuous form to be bent downward and away from said outlet side of said imaging device so that said continuous form is folded into a predetermined arrangement defined by the placement of said transverse preparations after passing over said top edge of said plate member.

32. A sheet guide mechanism for an imaging device having a fixing device which comprises means for heat pressing a continuous form, said continuous form having a plurality of transverse perforations at predetermined intervals of length along a longitudinal axis of said continuous form so as to divide said continuous form into a plurality of sheets, said sheet guide mechanism comprising:

an inclined plate member having a top edge and being arranged at an outlet side of said imaging device to upwardly guide said continuous form that is discharged from said device, said inclined plate member comprising means for causing each of said transverse perforations of said continuous form to pass over said top edge of said plate member and to be guided in an upward direction beyond said top edge, the weight of said continuous form causing said continuous form to be bent downward and away from said outlet side of said imaging device so that said continuous form is folded into a predetermined arrangement after passing over said top edge of said plate member.

* * * * *